United States Patent [19]

Sugiyama et al.

[11] 4,128,327

[45] Dec. 5, 1978

[54] TRANSFER MATERIAL FEED APPARATUS FOR ELECTROPHOTOGRAPHIC COPYING MACHINES

[75] Inventors: Mitsuhiko Sugiyama; Michio Shinkai, both of Ebina, Japan

[73] Assignee: Rank Xerox Limited, London, England

[21] Appl. No.: 844,851

[22] Filed: Oct. 25, 1977

[30] Foreign Application Priority Data

Oct. 26, 1976 [JP] Japan ..... 51/127876

[51] Int. Cl.[2] ..... G03G 15/00

[52] U.S. Cl. ..... 355/3 R; 271/270

[58] Field of Search ..... 355/35 H, 3 TR, 3 R, 355/14; 271/242, 243, 266, 270, 272, 273, 274

[56] References Cited

U.S. PATENT DOCUMENTS 2,220,264 11/1940 Morrison et al. ..... 271/242 X 3,601,392 8/1971 Spear et al. ..... 271/242

3,804,507 4/1974 Koch et al. ..... 355/14

*Primary Examiner*—Richard L. Moses

*Attorney, Agent, or Firm*—James J. Ralabate; Clarence A. Green; William A. Henry

[57] ABSTRACT

A method and apparatus is disclosed for synchronizing copy substrate positioning with an image position on a photoreceptor in an electrostatic copier that includes primary rollers which drive intermittently at a slower speed than copier process speed while feeding a copy substrate to the photoreceptor. Secondary rollers which are located between the primary rollers and the photoreceptor drive the copy substrate continuously at the process speed. After the copy substrate enters the secondary rollers, the primary rollers stop driving and allow the copy substrate to continue in travel by the driving force of the secondary rollers in synchronism with the image on the photoreceptor.

5 Claims, 5 Drawing Figures

TRANSFER MATERIAL FEED APPARATUS FOR ELECTROPHOTOGRAPHIC COPYING MACHINES

BACKGROUND OF THE INVENTION

This invention relates to copy sheet feed apparatus in an electrophotographic copying machine which feeds copy substrates to the print forming section of the photosensitive drum or belt in the copying machine.

Heretofore, this type of mechanism consisted of intermittently rotating rollers whose speed equalled the photosensitive drum surface speed, (hereinafter referred to as the process speed) or a cam type mechanism, which fed the copy substrate or transfer material on a signal from the copying process to synchronize it with the movement of the print-forming section of the photosensitive drum. For this type of mechanism it is difficult to minimize the error in matching the positions of the leading edge of the copy sheet to the print forming section of the photoreceptor below the allowable tolerance of about 2 mm. This is because it is impossible to perfectly synchronize the movement of the print-forming section of the photosensitive drum with the intermittent drive of the rollers due to the time difference between receipt of the signal and the rollers intermittent driving of the transfer material, the faster the rollers rotate the greater the error in adjusting the position of the leading edge of the transfer material to the print-forming section becomes as a result. Conversely, the slower the rotational speed the smaller the aforementioned positional error becomes. It is therefore desirable that the rollers rotate as slowly as possible. However, it becomes difficult to adjust the transfer material to the print-forming section on the photosensitive drum by only causing the rollers to revolve more slowly. This is due to the fact that the transfer material feed velocity must equal the process speed in order to adjust the transfer material to the print-forming section of the photosensitive drum.

Accordingly, it is an object of the present invention to reduce the positional error between a leading edge of the copy substrates and an image on a photoreceptor.

Yet another object of the present invention is to diminish positional error between an image on a photoreceptor and a copy sheet by adjusting the feed velocity of the copy sheet to the photoreceptor velocity.

The foregoing and other objects of the present invention are accomplished by driving the transfer material toward the photoreceptor with primary rollers revolving at a speed less than the speed of the photoreceptor toward a nip formed by secondary rollers which are rotating at a speed equal to the photoreceptor speed. As the transfer material reaches the nip of the secondary rollers and is gripped thereby the primary rollers stop their driving force and allow the transfer material to be synchronously driven by the secondary rollers at the same speed as the photoreceptor in order for an image to be transferred from the photoreceptor to the transfer material.

BRIEF DESCRIPTION OF THE DRAWINGS

Further objects, features and advantages of the present invention pertain to the particular apparatus, steps, and details whereby the above-mentioned aspects of the invention are attained. Accordingly, the invention will be better understood by reference to the following description and to the drawings forming a part thereof.

DESCRIPTION OF THE PREFERRED EMBODIMENT

The apparatus of the present invention includes primary drive rollers 1 that are intermittently driven. Between these rollers 1, and the photosensitive drum 2 is situated the continuously rotating secondary drive rollers 3. The primary rollers 1 are driven intermittently in order to synchronize them with the movement of the print forming section of the photosensitive drum 2, the speed of rotation is slower than the surface velocity (process speed) of the photosensitive drum, and power is transmitted to the rollers through a one-way clutch which allows them to turn freely in the transfer material feed-out direction, a, and the opposite direction, b. The aforementioned secondary rollers 3, are continuously driven at the process speed.

Figure 1:
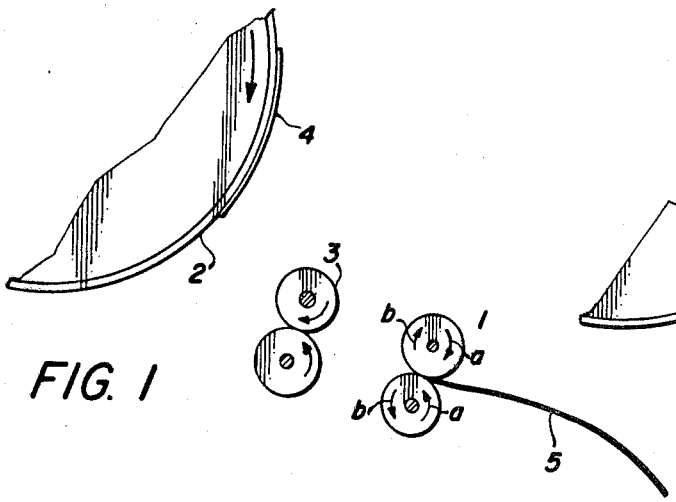
FIG. 1 is a partial side view of the present invention showing transfer material at the nip of the primary rollers.
Figure 2:
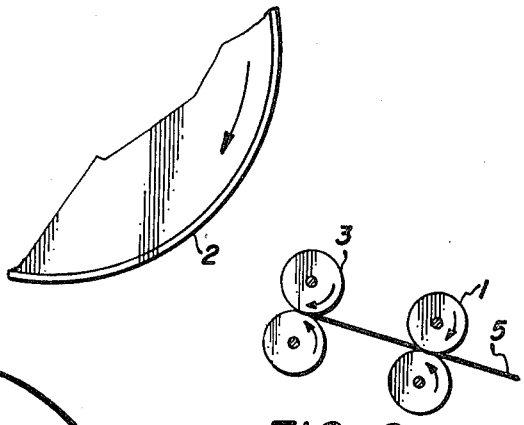
FIG. 2 is a partial side view of the present invention showing transfer material entering the nip of secondary rollers.
Figure 3:
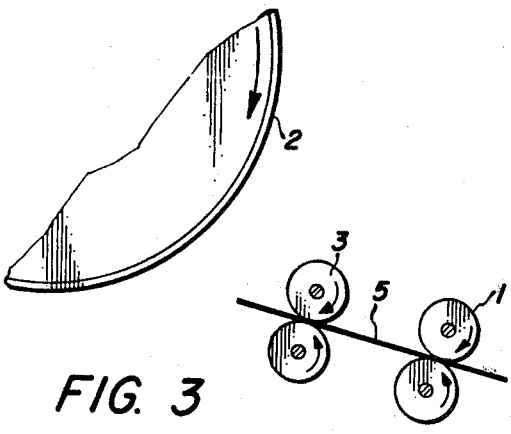
FIG. 3 is a partial side view of the present invention showing transfer material being driven by secondary rollers.

FIG. 1 shows the transfer material just entering the primary rollers 1 but curved and not moving since the primary rollers 1 are at a standstill, and it is from this point that the synchronization sensing of the movement of the print-forming section of the photosensitive drum takes place. The signal for synchronization with the print-forming section 4 is then received and the primary rollers 1 are driven at slower than process speed to pass the transfer material or copy sheet material 5 onto the secondary rollers 3 as shown in FIG. 2. The signal for synchronization is conventional and can come from the START/PRINT button or the mechanisms and systems disclosed in U.S. Pat. No. 3,719,267 to Walter Reist et al and U.S. Pat. No. 3,888,579 to Victor Rodek et al both of which are hereby incorporated herein by reference. It is due to the driving of the primary rollers at a slower than process speed that the timing error is reduced and the positional error in adjusting the leading edge of the transfer material 5 and the print-forming section 4 is reduced.

After the transfer material enters the secondary rollers 3 the primary rollers 1 stop driving and the transfer material 5 is fed onto the print-forming section 4 of the photosensitive drum 2 by the secondary rollers 3. However, since the secondary rollers 3 are rotating at the set or predetermined process speed, the feed velocity of the transfer material 5 is identical to the photosensitive drum's surface velocity thereby making possible the adjustment of the transfer material 5 to the print-forming section 4.

At this time, the primary rollers receive a rotating force in the feed-out direction, a, from the transfer material 5, but because of the one-way clutch they are free to rotate in the, b, direction and do so as a result of the transfer materials movement. It is in this way that the transfer material 5 can be fed to the photosensitive drum 2 at exactly the process speed of the secondary rollers 3 even though the primary rollers speed is slower. Therefore, the positional error of the leading edge of the transfer material 5 can be reduced and the transfer material can be adjusted to the print-forming section 4.

Figure 5:
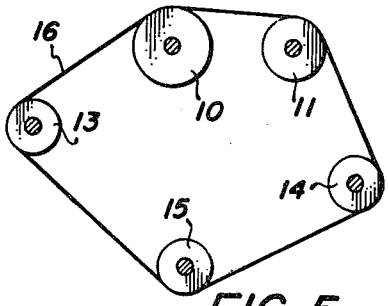
FIG. 5 is a side view of FIG. 4 taken along section V.
Figure 4:
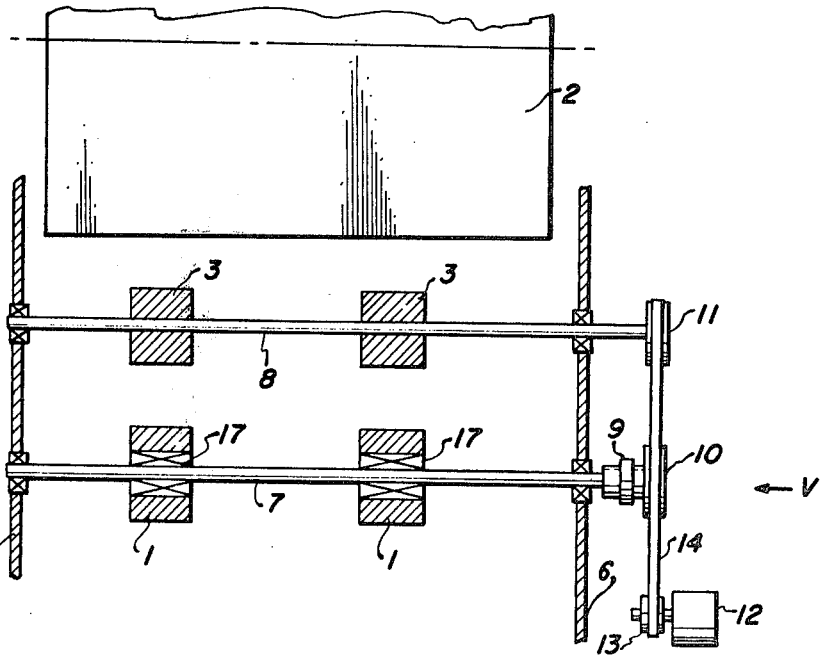
FIG. 4 is a plan view of the present invention showing the drive mechanisms for the primary and secondary rollers.

The drive mechanism for the primary rollers 1 and the secondary rollers 3 is shown in FIGS. 4 and 5. The two sides of the frame 6 support the primary and secondary shafts, 7 and 8, respectively, which span the frame and are free to rotate. The primary roller shaft 7 has an electromagnetic clutch 9 to provide the intermittent drive from pulley 10, and the secondary roller shaft 8 has pulley 11 attached. Timing belt 16 goes around pulley 13, the drive source 12, idler pulleys 14 and 15, pulley 10, and pulley 11. Pulley 10 has a larger diameter than pulley 11. Also, the primary rollers 1 and the primary roller shaft 7 have clutches 17 while the secondary rollers are solid with the secondary roller shaft 8. The drive mechanism for the primary rollers 1 and secondary rollers 3 is not restricted to this construction and chain and sprocket type transmission may be used as well.

In conclusion, an apparatus and method is disclosed for synchronizing the positioning of a copy sheet in relation to an image on a photosensitive member by the use of two sets of driving rollers. The first set of drive rollers rotate at a speed slower than the speed of the surface of the photosensitive member while the second set of driving rollers rotate at the same speed as the photosensitive member. The primary rollers drive copy sheet material intermittently toward a nip formed between the secondary rollers and once the secondary rollers grip the copy sheet material, synchronization is attained between an image on the photosensitive member and the copy sheet material. Therefore, the positional error in adjusting the leading edge of the copy sheet material 5 to the print-forming section 4 can be reduced and the feed velocity of the copy sheet material 5 can be made equal to the surface velocity of the photosensitive member 2 thereby making possible the adjusting of the copy sheet material 5 to the print-forming section 4.

In addition to the method and apparatus disclosed above many other modifications and/or additions to this invention will be readily apparent to those skilled in the art upon reading this disclosure, these are intended to be encompassed in the invention disclosed and claimed herein.

What is claimed is:

1. In an electrostatic copier having a photosensitive member rotatable at a set velocity and capable of receiving an image of an original document thereon and means for feeding copy substrates toward said photosensitive member to have the image transferred thereto, the improvement comprising:

positional correctional means for synchronizing the position of the copy substrates with the image on said photosensitive member, said positional correctional means comprising a first set of primary rollers for driving the substrates from a supply source toward said photosensitive member at a slower velocity than said set velocity and a second set of secondary rollers that receive the copy substrates from said primary rollers and transports them to said photosensitive member, said secondary rollers being continuously driven at a velocity equal to the velocity of said photosensitive member.

2. The improvement of claim 1 wherein said primary rollers cease driving once the copy substrates are gripped by said secondary rollers.

3. The improvement of claim 2 including clutch means connected to said primary rollers allowing them to continue rotation in the feed-out direction.

4. A method of synchronizing the position of a copy substrate with an image on a photosensitive member, comprising the steps of:

(a) providing a photosensitive member rotating at a set velocity with a transferrable image thereon;

(b) feeding a copy substrate with a first feeding means at a slower velocity than said set velocity toward said photoreceptor;

(c) receiving said substrate by a second feeding means; and (d) feeding said substrate with said second feeding means at a velocity equal to said set velocity of said photosensitive member to said photosensitive member.

5. The method of claim 4 wherein said first and second feeding means are rollers.

* * * * *